US006635003B2

(12) United States Patent
Marchant

(10) Patent No.: US 6,635,003 B2
(45) Date of Patent: Oct. 21, 2003

(54) METHOD FOR LAYING OUT ENVELOPE BLANK

(76) Inventor: Eric A. Marchant, 401 Hyde Park, Doylestown, PA (US) 18901

( * ) Notice: Subject to any disclaimer, the term of this patent is extended or adjusted under 35 U.S.C. 154(b) by 0 days.

(21) Appl. No.: 10/180,630

(22) Filed: Jun. 26, 2002

(65) Prior Publication Data

US 2002/0165076 A1 Nov. 7, 2002

Related U.S. Application Data

(62) Division of application No. 09/481,039, filed on Jan. 11, 2000, now abandoned.

(51) Int. Cl.[7] ..... B31B 1/26

(52) U.S. Cl. ..... 493/231; 493/917; 493/243; 493/405; 229/75; 229/68.1; 33/562; 33/566

(58) Field of Search ..... 493/917, 232, 493/235, 231, 243, 245, 405, 237, 229; 33/562, 563, 566, 1 B, 483, 492, 11, 4, 16; 229/75, 68.1

(56) References Cited

U.S. PATENT DOCUMENTS

| | | | | | |
|---|---|---|---|---|---|
| 67,487 | A | | 8/1867 | Bostock | 33/454 |
| D32,156 | S | | 1/1900 | Johnson | |
| 688,061 | A | * | 12/1901 | Bustanoby | 33/454 |
| 694,185 | A | | 2/1902 | Page | 33/454 |
| 1,600,246 | A | | 9/1926 | Rehnqvist | 33/454 |
| 2,021,620 | A | * | 11/1935 | Weir | 229/75 |
| 2,155,656 | A | | 4/1939 | Hayes | 93/61 |
| 2,718,828 | A | * | 9/1955 | Buda et al. | 493/228 |
| 2,920,539 | A | | 1/1960 | Doetsch | 493/266 |
| D195,225 | S | * | 5/1963 | Traum | D10/62 |
| 3,457,696 | A | * | 7/1969 | Berkley | 53/460 |
| 4,641,436 | A | * | 2/1987 | Tzen et al. | 33/483 |
| 4,734,993 | A | | 4/1988 | Pan | 33/483 |
| 4,744,509 | A | * | 5/1988 | Buchler-Dopheide | 229/92.1 |
| 5,058,285 | A | | 10/1991 | Morita et al. | 33/563 |
| 5,472,029 | A | | 12/1995 | Ketch | 144/371 |
| 5,518,491 | A | | 5/1996 | Romer et al. | 493/231 |
| 5,626,551 | A | | 5/1997 | Kearns et al. | 493/231 |
| 5,685,816 | A | | 11/1997 | Romer | 493/231 |
| 5,795,282 | A | * | 8/1998 | deMunnik | 493/210 |
| 6,158,135 | A | | 12/2000 | Rank | 33/494 |

* cited by examiner

*Primary Examiner*—Rinaldi I. Rada
*Assistant Examiner*—Thanh Truong
(74) *Attorney, Agent, or Firm*—Drinker Biddle & Reath LLP

(57) ABSTRACT

A method for laying out an envelope blank on a sheet of material using a template having a straightedge portion with layout edge and an alignment portion with alignment field. The user places an item to be enclosed in an envelope onto the sheet, places marks thereon to locate approximately the corners of the item and removes the item. The user places the template thereon, adjustably aligns the edge of the straight-edge portion on the sheet until the alignment element is lined up as parallel as possible with two diagonally opposed marks. The layout edge being thus aligned, the user draws a line representing a layout line substantially along the edge. In repeating this process for each mark, the user draws remaining layout lines. After drawing all layout lines, the user removes the template from the sheet; the envelope blank is formed from the layout lines.

13 Claims, 9 Drawing Sheets

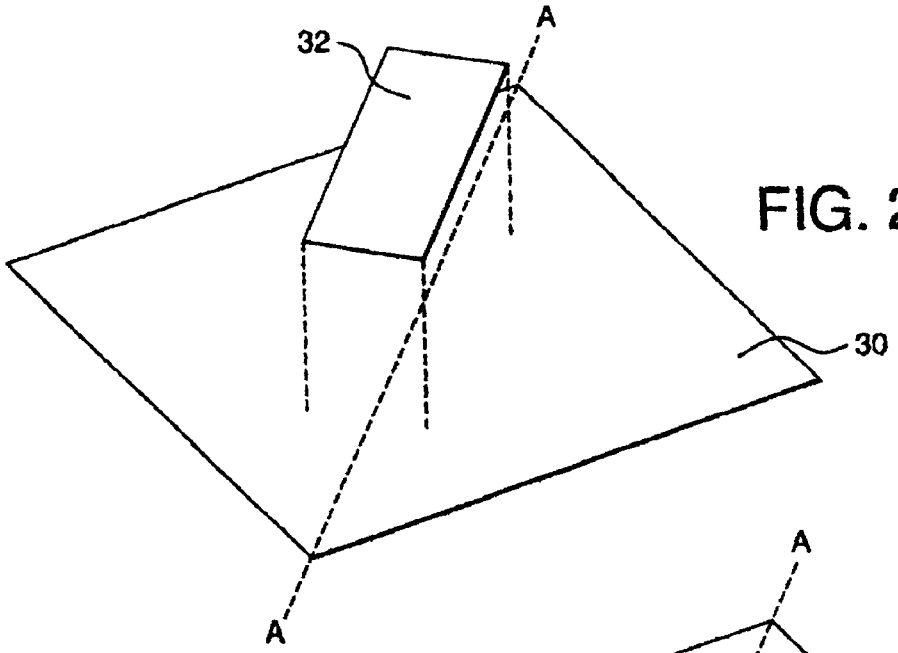
FIG. 2
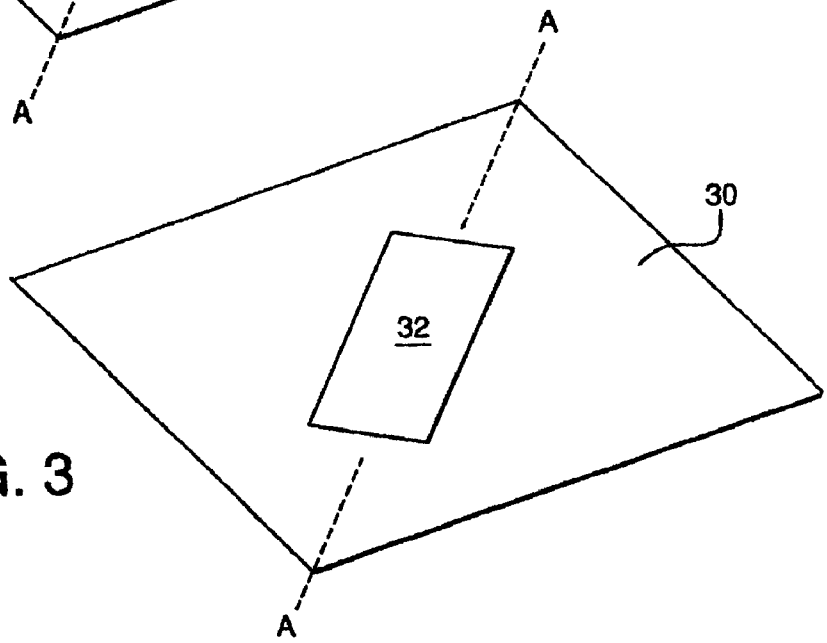
FIG. 3
FIG. 4
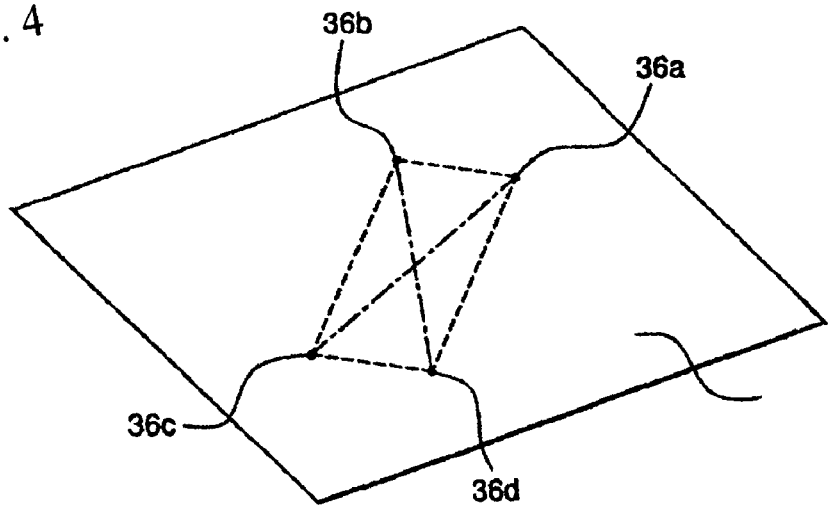

METHOD FOR LAYING OUT ENVELOPE BLANK

CROSS REFERENCE TO RELATED APPLICATION

This application is a divisional of and claims priority from U.S. application Ser. No. 09/481,039, filed Jan. 11, 2000 now abandoned.

FIELD OF THE INVENTION

The present invention relates to a template for laying out an envelope blank on a sheet of material. In particular, the present invention relates to a template and method for laying out an envelope blank that can be sized specifically for an item to be enclosed in the envelope. The invention facilitates the design of envelopes to accommodate items of nonstandard sizes and shapes.

BACKGROUND OF THE INVENTION

Envelopes for holding items are well known. Typically, envelopes are used to hold a variety of items, such as greeting cards, notes, letters, coins, keys, small parts, and the like. Envelopes are generally made from envelope blanks based on standard patterns cut from sheets of material such as paper stock or card stock, or the like. Typically, the envelope blanks are mass-produced by machines, using dies and other types of cutting devices. Individual envelope blanks are then folded to make an envelope.

To make it economical to machine-produce large quantities of envelope blanks at one time, envelopes come in a limited number of standard sizes. While this is fine in many cases, it is not the best solution in all cases. With the advent of personal computers, it has become increasingly possible, and popular, for consumers to make personalized stationery and greeting cards. For example, there are a number of kits and computer programs available for consumers to make personalized greeting cards. However, most card making kits and computer programs have little flexibility to allow the user to make cards of shapes and sizes to fit standard envelopes. In fact, in most cases, the user is limited to only one size. The card is made or printed on a sheet of standard 8½ by 11, and the sheet must then be folded in quarters to form the finished card. This results in a card that does not fit a standard envelope. For example, the card dimensions after folding would be 4.25 by 5.5 inches. Commonly found No. 10 envelopes are 4.13 by 9.5 inches either of those standard envelopes. A No. 11 envelope, at 4.5 by 10.37 inches, could be used, but would clearly be too large and wasteful of material.

Also, it is not uncommon for an envelope for a greeting card purchased from a store to become damaged or lost. This usually occurs after a person has already left the store and is ready to use the greeting card. Moreover, sometimes a purchaser picks up an envelope that is not the one intended by the manufacturer to go with the card, and does not notice the error until much later. As a result, in order to place the greeting card in an envelope, the purchaser would have to either return to the store to find a replacement envelope or endure the task of trying to make from scratch an envelope that will have a professional appearance when completed. Each of these options is time consuming and inconvenient.

Accordingly, there is a need for a device and an easy method for making envelopes of nonstandard sizes. Such a device and method should enable one to make an envelope that will be sized specifically for a particular item to be placed in the envelope, and that will have a neat and professional appearance when completed. The present invention meets these and other needs.

SUMMARY OF THE INVENTION

The present invention is directed to a template for laying out an envelope blank on a sheet of material. The template includes a straightedge portion having an edge that is used as a guide to form a line representing a layout line of an envelope blank and an alignment portion. The alignment portion includes an alignment field having an alignment element for adjustably locating the straightedge portion on the sheet.

The invention also contemplates a method of using the template. To use the template, an item to be enclosed by an envelope is placed on the sheet, and marks are placed on the sheet to approximately locate the corners of the item. The item is then removed from the sheet, and the template is placed on the sheet. To place the template in proper position, the edge of the straightedge portion is aligned on the sheet relative to at least one of the marks to locate the proper position of the first layout line. The edge is aligned by manipulating the alignment field as necessary until the alignment element is lined up with two diagonally opposed marks. Once the edge is properly aligned, a line representing the first layout line for the envelope blank is drawn substantially along substantially the entire length of the edge. After the first layout line is drawn, the template may be repositioned using each of the remaining marks as a separate reference to draw the remaining layout lines of the envelope blank. After all the layout lines are defined, the envelope blank may be removed from the sheet and folded to form a finished envelope.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

FIG. 2 is an exploded perspective view of a sheet of envelope material, such as paper, shown relative to an item to be enclosed in an envelope, such as a card.

FIG. 3 is a perspective view of the paper and card shown in FIG. 2, with the card placed on the paper.

FIG. 4 is a perspective view of the paper shown in FIGS. 2 and 3, with marks indicating the approximate location of the corners of the card, which has been removed.

DETAILED DESCRIPTION OF THE DRAWINGS

Figure 1:
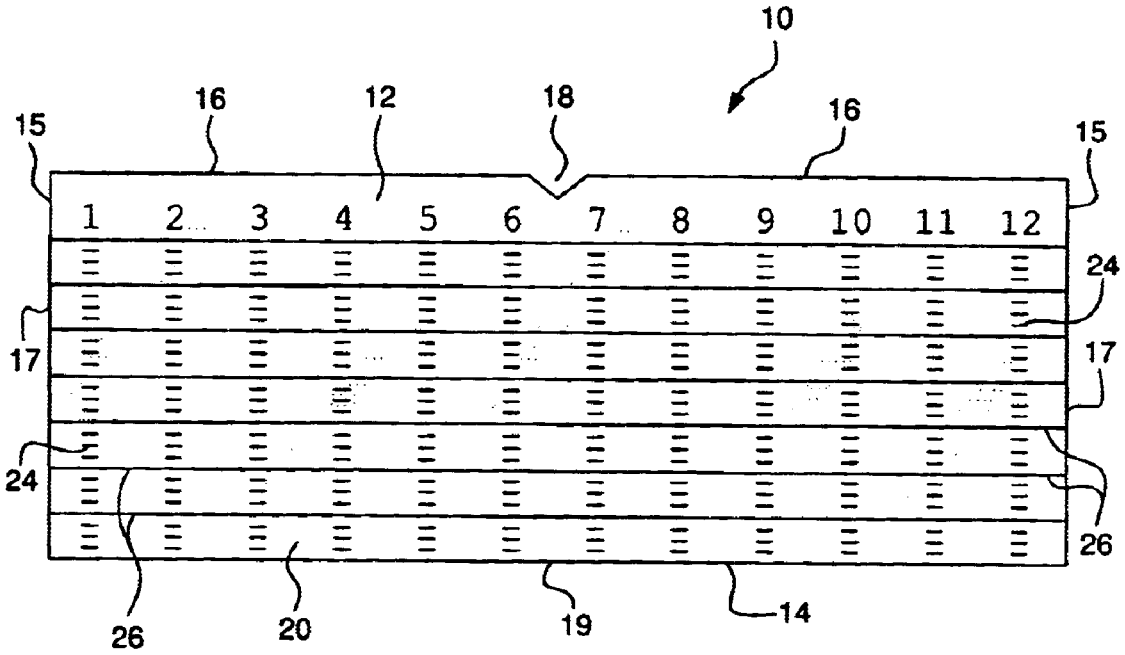
FIG. 1 is a top plan view of a template for laying out an envelope blank according to the present invention.

In the drawings, where like numerals identify like elements, there are shown various embodiments of a template for laying out an envelope blank to make an envelope of a desired size for holding an item. Although the present invention will be described in terms of making an envelope of nonstandard size for a card, it should be understood that the invention is not so limited. Rather, the invention is equally capable of being used to lay out envelope blanks of any desired size, including standard sizes, and for holding any desired items other than or in addition to cards. The invention may be used to lay out envelope blanks for odd-sized documents such as photographs, tickets, transaction slips, and the like, or for objects such as coins, keys, jewelry items, small parts, and so forth.

As shown in FIG. 1, the template 10 is a generally rectangular thin sheet, and is preferably made in one piece from durable lightweight material, such as plastic. Preferably, the template 10 is substantially transparent and substantially flat, so that it will lie flat on the face of a sheet of material from which an envelope blank is to be made. The template 10 comprises a straightedge portion 12 and an alignment portion 14 that cooperate with each other to lay out the envelope blank, as explained below.

The straightedge portion 12 has a peripheral layout edge 16 that is used as a guide to mark layout lines on a sheet of material to lay out an envelope blank to make the envelope. Preferably, the edge 16 includes a cutout or opening, such as notch 18, which is used to place the template 10 on the sheet of material at the proper location, as will be described in greater detail below. Notch 18 is also used to form relieved areas of the envelope blank, which facilitate folding the envelope blank to complete the envelope, as will also be discussed below. Notch 18 is preferably V-shaped, and is located at approximately the center of the straightedge portion 12 to partition the edge 16 into two substantially straight coequal lengths. However, although the preferred shape for notch 18 is V-shaped, shapes other than V-shaped can be used without departing from the invention. In addition, although not preferred, notch 18 can be omitted and replaced by some other form of indicium, such as a circular opening or a symbol on template 10, to place the template 10 at the proper location on the sheet of material.

The alignment portion 14 is associated with the straightedge portion 12 to adjustably align the edge 16 on the sheet of material. Preferably, the alignment portion 14 comprises an alignment field 20 having an alignment element used to adjust the orientation of the edge 16 on the sheet of material, so that it is in proper position. Preferably, the alignment element is defined by a plurality of parallel lines that form a scale 22 the scale 22 comprises two sets of parallel lines, a first set 24 and a second set 26. The first set of lines 24 are relatively short segments that are parallel to edge 16 and extend perpendicular to the straightedge portion 12 in individual columns, which terminate just above the bottom end 19 of the template 10. Intersecting each column at spaced intervals are the second set of lines 26 that are parallel to each other and parallel to the edge 16. Both the first set 24 and second set 26 of lines cooperate with each other to provide a scale for adjustably aligning the edge 16 on the sheet of material so that layout lines can be marked to create the envelope blank.

Still referring to FIG. 1, the straightedge portion 12 may include indicia markings 28, illustrated by numerals "1" to "12", located laterally across the surface of the straightedge portion 12 intermediate sides 15. Each indicia marking 28 is associated with at least one of the columns of lines 26. The indicia markings 28 may be used with the first set 24 and second set 26 of lines for measuring or laying off distances or dimensions, which may be helpful in laying out the envelope blank from the template 10. The specific number of columns, and the specific number of lines 24 and 26 is not critical to the invention, and those skilled in the art will appreciate that numerous variations in the number, spacing, and arrangement of lines can be made as desired without departing from the essential elements of the invention. In addition, while indicia markings 28 in the form of numerals 1 through 12 are illustrated, the indicia markings are provided as a guide to the user to aid in aligning the template 10 on the sheet of material. The indicia markings 28 are not limited to specific characters or symbols, and may even be omitted altogether without departing from the invention.

The template 10 has been described above as made in one-piece. However, other embodiments are contemplated. For example, it is contemplated that the template 10 may be formed in two parts that are joined together, wherein the first part is the straightedge portion 12 and the second part is the alignment portion 14. It is also contemplated that the template 10 can have a variety of shapes and sizes so long as the template 10 can be used to lay out the envelope blank as described in the steps below.

The steps of using the template 10 to lay out an envelope blank from a sheet of material are illustrated in FIGS. 2 to 12. FIG. 2 shows a sheet of material 30, such as paper stock, card stock, fabric, or the like. The sheet of material is used to form an envelope for an item 32, such as a greeting card, letter, note card, keys, coins, and the like. For purposes of illustration and description only, the sheet of material 30 is considered to be paper and the item 32 is considered to be a rectangularly shaped card.

As shown in FIGS. 2 and 3, the card 32 is placed diagonally on the surface of the paper 30, just about in the center. The sides of the card 32 should be oriented or aligned approximately parallel to the diagonal 34 of the paper 30, illustrated by line A—A. It has been found useful to select paper 30 with sides approximately twice as long as the sides of the card 32 to be placed in the envelope. This will ensure that there is enough material to lay out the envelope blank.

After the card 32 is placed in the center of the paper 30, the user marks the approximate locations of the corners of the card 32 with location marks, such as dots 36*a*–36*d*, as shown in FIG. 4. The marks 36 identify the approximate orientation and dimensions of the card 32, as illustrated by the broken lines, and define two diagonals, one diagonal being defined between marks 36*a* and 36*c* and the other diagonal being defined by marks 36*b* and 36*d*. The marks 36*a*–36*d* also define the dimensions of the face of what will become the finished envelope, which will be used for the address. After the marks 36*a*–36*d* are made, the card 32 may be removed from the paper 30.

Figure 5:
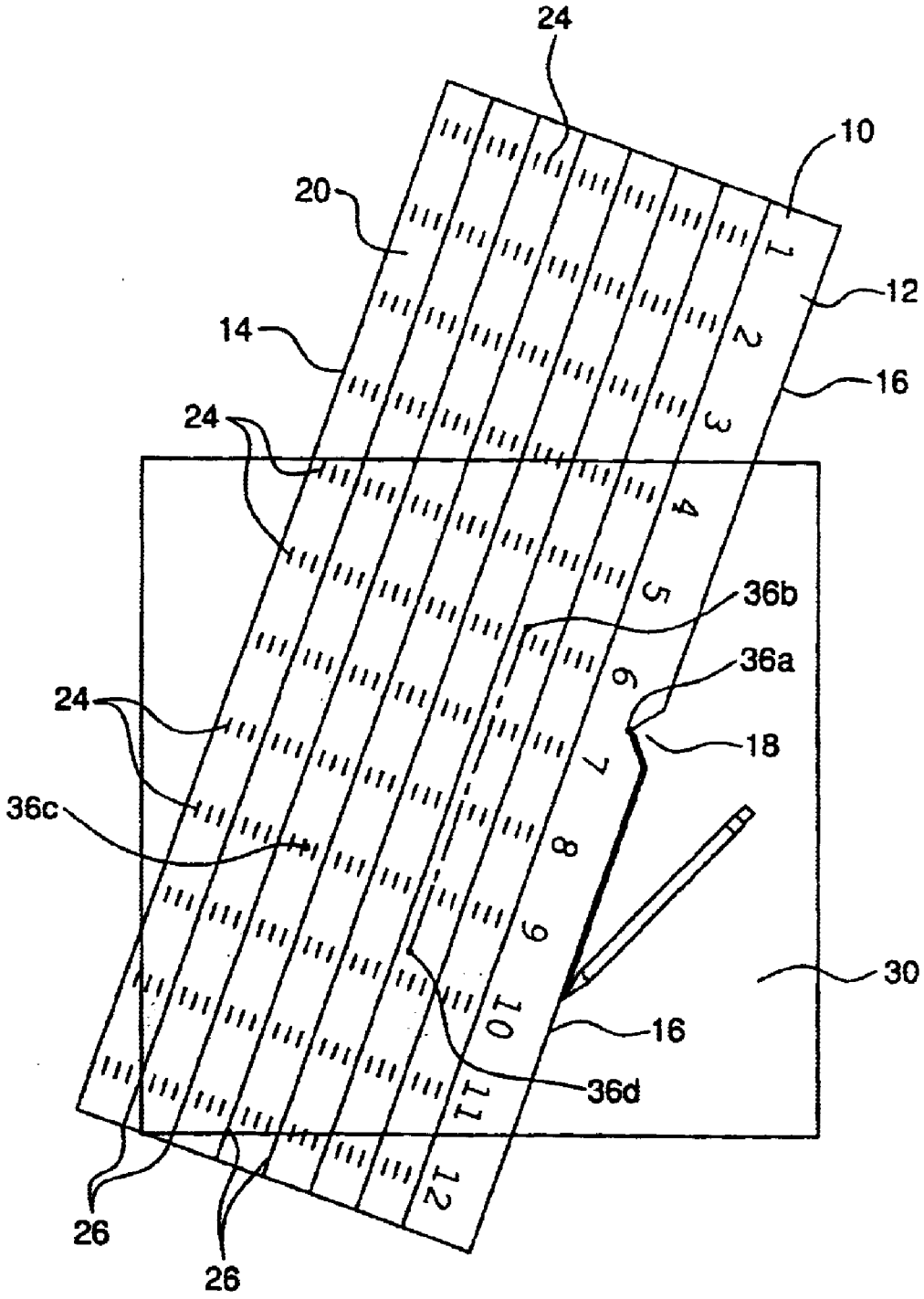
FIG. 5 is a top plan view of the device shown in FIG. 1, placed on the paper relative to the marks.

Next, the template 10 is placed on the surface of the paper 30 relative to one of the marks 36*a*–36*d* which indicate the corners of the card 30, as shown in FIG. 5. To place the template 10 in proper position, the straightedge portion 12 is moved so that at least one of the marks, in this case 36*a*, is positioned within the notch 18, preferably at the apex of the notch. After the template is manipulated so that the mark is located within the notch 18, the alignment field 20 is used to align the edge 16 on the paper 30 to locate the position of the first layout line for the envelope blank. The edge 16 is aligned by moving the template 10 as necessary until the diagonal (shown as a broken line in FIG. 5) defined by the two diagonally opposed marks, in this example 36*b* and 36*d*, is lined up as parallel as possible to one of the parallel lines, either 24 and/or 26, of the scale 22. Once the scale 22 and the diagonal defined by the marks 36*b* and 36*d* are so aligned, a line representing the first layout line for the envelope blank is drawn by the user along substantially the entire length of the edge 16, including notch 18.

Figure 6:
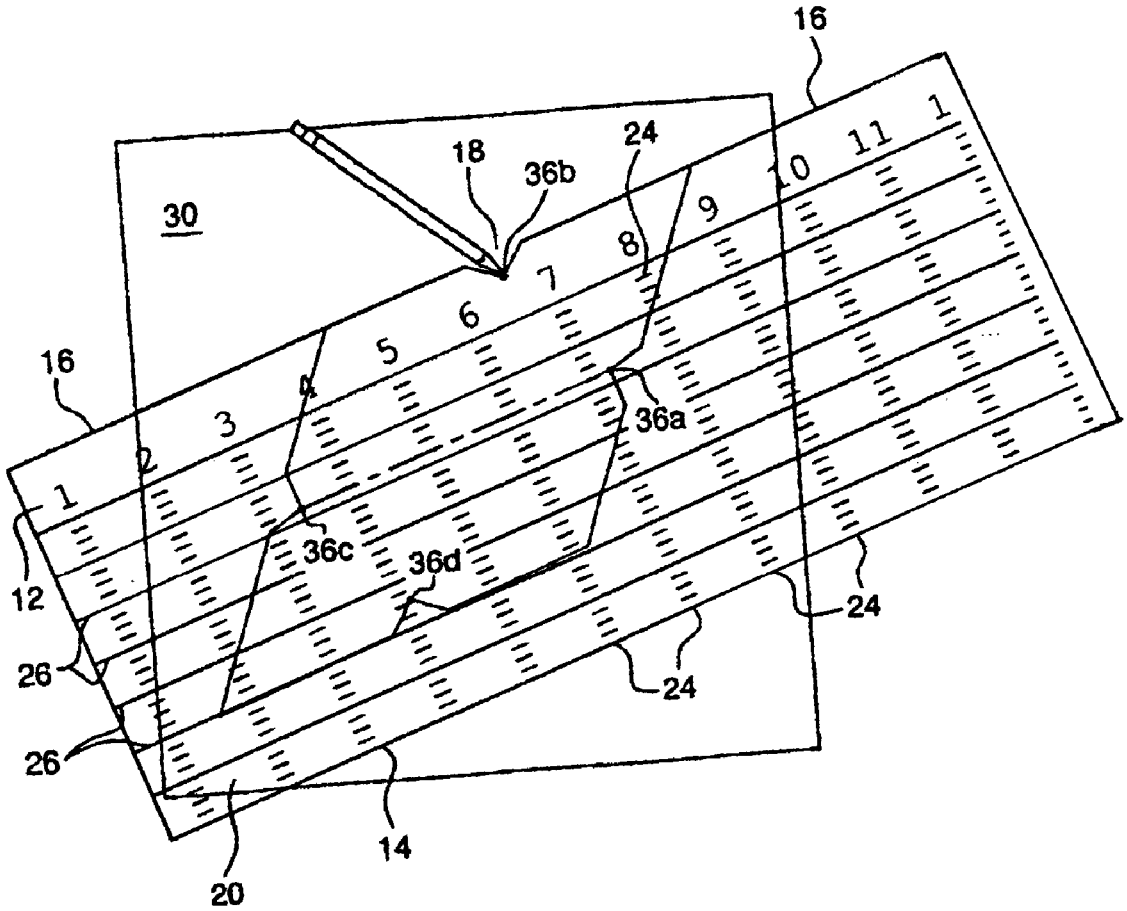
FIGS. 6–12 show the sequential steps of using the template according to the invention to lay out an envelope blank for the card.
Figure 7:
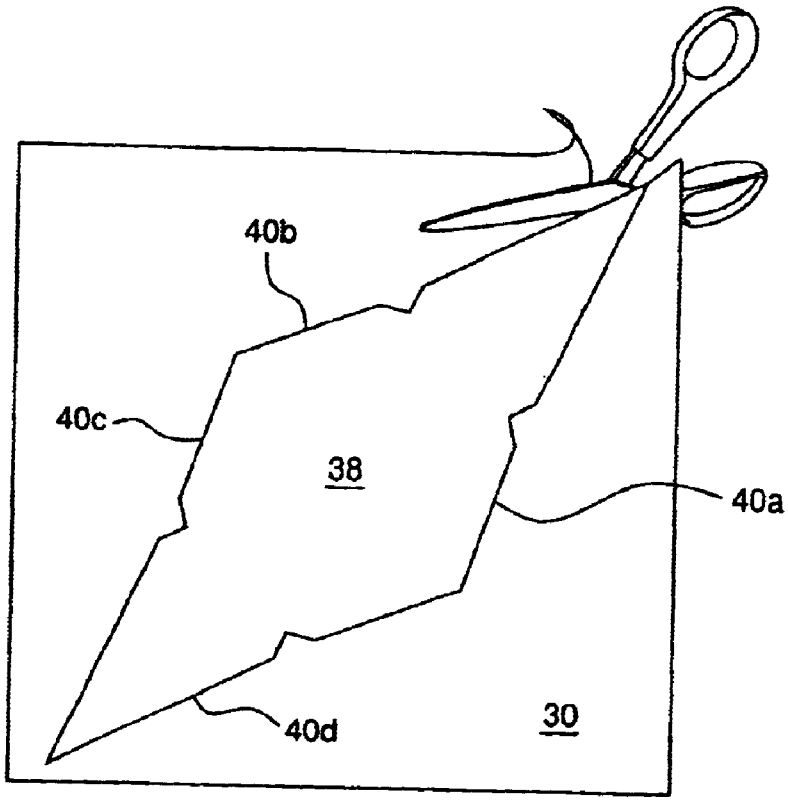

After the first layout line is drawn, the process is then repeated, using each of the remaining marks 36*b*–36*d* as the reference mark for notch 18, to form the remaining layout lines. Thus, for example, the template is moved so that the mark 36*b* is located in notch 18, and the scale is aligned to be parallel with the diagonal defined by marks 36*a* and 36*c*, as shown in FIG. 6. After the process is completed for all four reference marks, there will be four layout lines which intersect each other to form a rhomboid pattern, which is the envelope blank 38, on the paper 30, as seen in FIG. 7. Once the envelope blank 38 is laid out, it can be cut out from the paper 30 by trimming off the excess material outside the layout lines, such as with a scissors.

Figure 8:
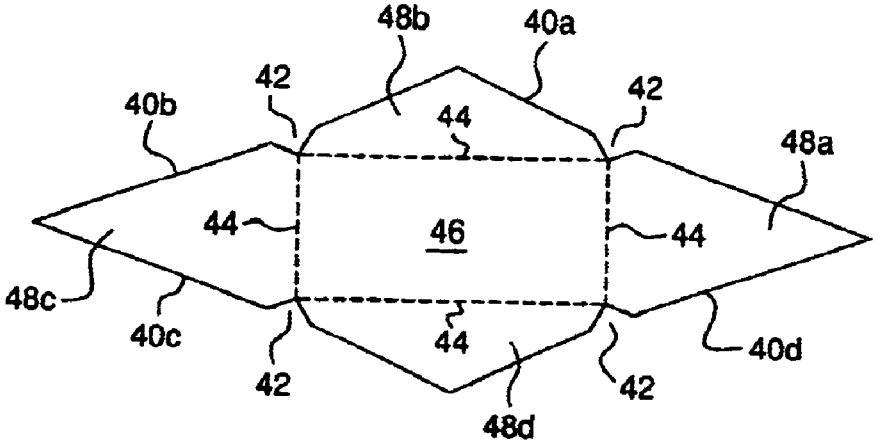

As best seen in FIG. 8, the envelope blank 38 is in the shape of a rhomboid or parallelogram comprising four sides 40*a*–40*d* that are joined at the corners. Each side 40 of the envelope blank 38 includes at approximately its center a relieved area or notch 42, which was formed by marking the layout lines along the notch 18 of the edge 16. The notches 42 can be used to define fold lines, illustrated by the broken lines connecting each notch 42, which in turn define envelope sealing flaps 48*a*–48*d* and an envelope face 46. The envelope face 46 will have relatively the same dimensions as the face of card 32, i.e., the corners 36*a*–36*d* should coincide with the location of each notch 42.

Figure 9:
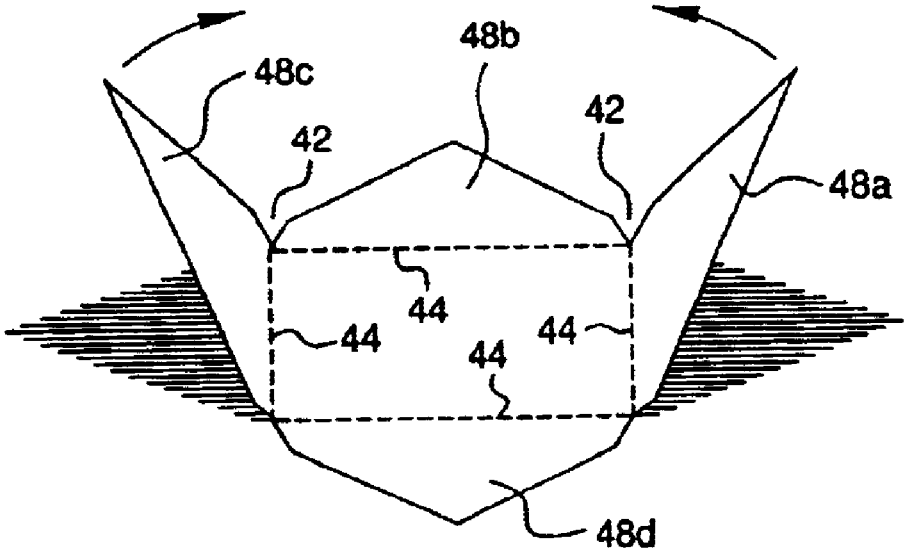
Figure 10:
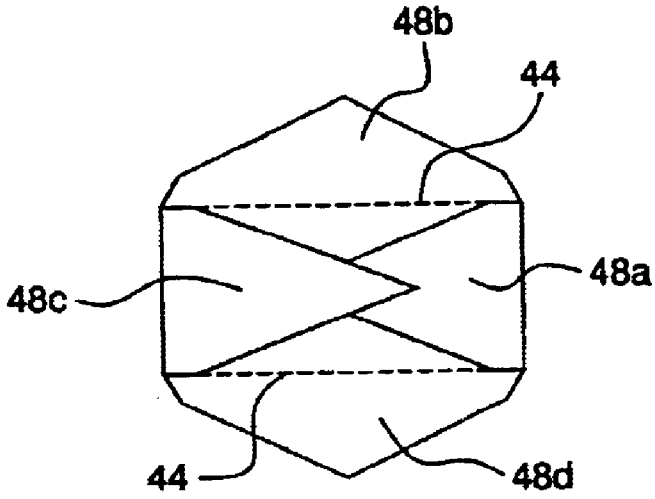
Figure 11:
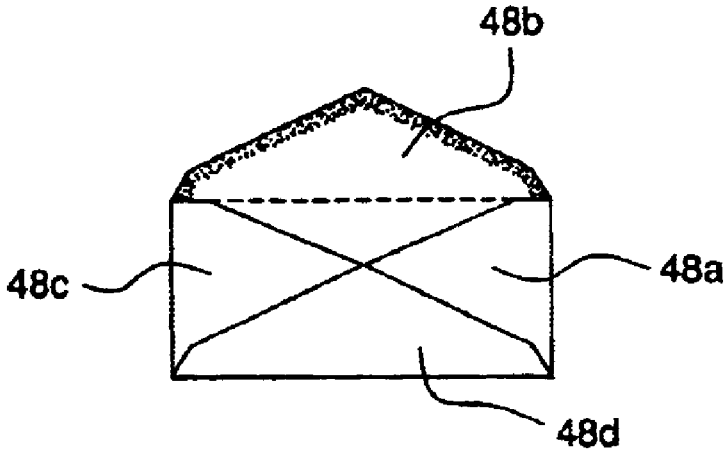

To form a finished envelope, at least two of the sealing flaps 48 are folded about their corresponding fold lines 44 so that one will overlie the other. For example, as illustrated in FIGS. 9 to 11, sealing flaps 48*a* and 48*c* are folded inwardly about line 44 such that flap 48*c* overlies flap 48*a*. The notches 42 located on opposite sides of the fold lines 44 help to facilitate the folding of the corners of the envelope blank 38 to create crisp, neat edges. The crisp, neat edges add to the professional appearance of the envelope formed from the envelope blank 38 when the flaps are folded. To keep the folded flaps together, adhesives such as glue may be used.

Figure 12:
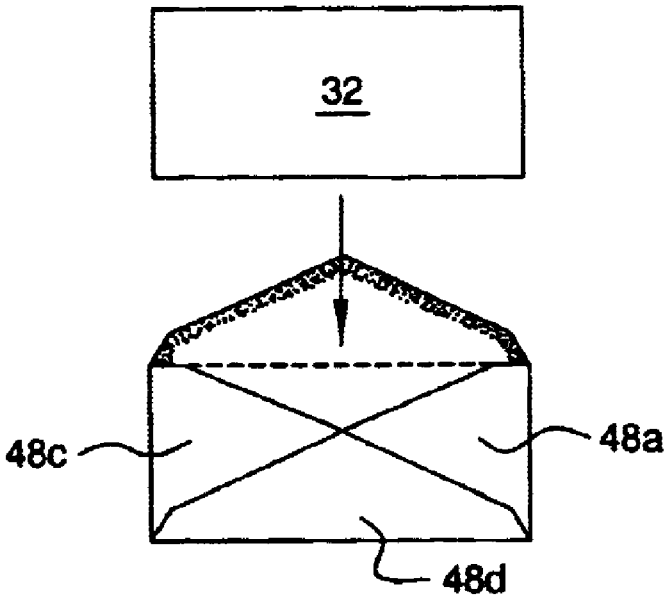

Next, as shown in FIGS. 10 and 11, sealing flap 48*d* is then folded to overlie a portion of now folded flaps 48*a* and 48*c* to form a partially complete envelope 50 having an interior pocket sized specifically to receive the card 32. After the interior pocket is formed, the card 32 may be inserted into the interior and the envelope 50 sealed in conventional fashion by folding flap 48*b* to overlie 48*d*. Moisture activated adhesives may be placed on flap 48*b*, as depicted in FIGS. 11 and 12, or other sealing means such as tape, sealing wax, and the like, may be used to seal the finished envelope. Once sealed, the envelope 50 will snugly enclose the card 32 and have a neat, professional appearance.

The template 10 and method described herein provide an easy way to make envelopes for most types of items, such as greeting cards or letters. In particular, the template 10 described above and the method of using the same help to establish a relationship between the envelope blank and the particular item. That is, the template 10 ensures that the sides of the envelope blank will be parallel to the diagonal of the item. This relationship facilitates making an envelope from the envelope blank that is tailored to the item and, when completed, will enclose the item with little wasted space.

Persons skilled in the art will appreciate that the size of the envelope may be either increased or decreased as desired. For example, a larger or smaller sized envelope may be made from the template 10 by locating the edge 16 either inwardly or outwardly of the marks. In this way, after the template 10 is properly aligned using the alignment field 20, the line formed along the edge 16 will be inward or outward of the corresponding mark, which serves as reference. After the lines are drawn for each of the marks, the envelope blank will be either large or small, in comparison to an envelope blank made if the edge 16 is aligned on the mark, such as envelope blank 38, illustrated in FIG. 8. Nonetheless, no matter how large or small the envelope blank is, the sides of the envelope blank will remain parallel to the diagonal of the item so that the envelope blank can be easily folded into an envelope having a finished professional appearance.

Although both the paper 30 and card 32 shown in the drawings and described above are rectangular, other shapes are contemplated. For example, the paper 30 may be any shape and size so long as the sides are long enough to form the envelope blank. In addition, even if the card 32 is not rectangular, which is typical of some greeting cards and other items, the template 10 and method described above may still be used to form the envelope blank. For instance, if the item to be enclosed in the envelope is non-rectangular, marks such as 36*a*–36*d* should be simply placed around the perimeter of the item to form a rectangle, as illustrated in FIG. 4 discussed above. After the marks have been formed, steps for using the template 10 can be used to lay out an envelope blank from the sheet of material that will be large enough to receive the non-rectangular shaped item. Thus, the present invention provides flexibility to lay out an envelope blank that can be used to make both standard and nonstandard sized envelopes for rectangular and non-rectangular items.

Figure 13:
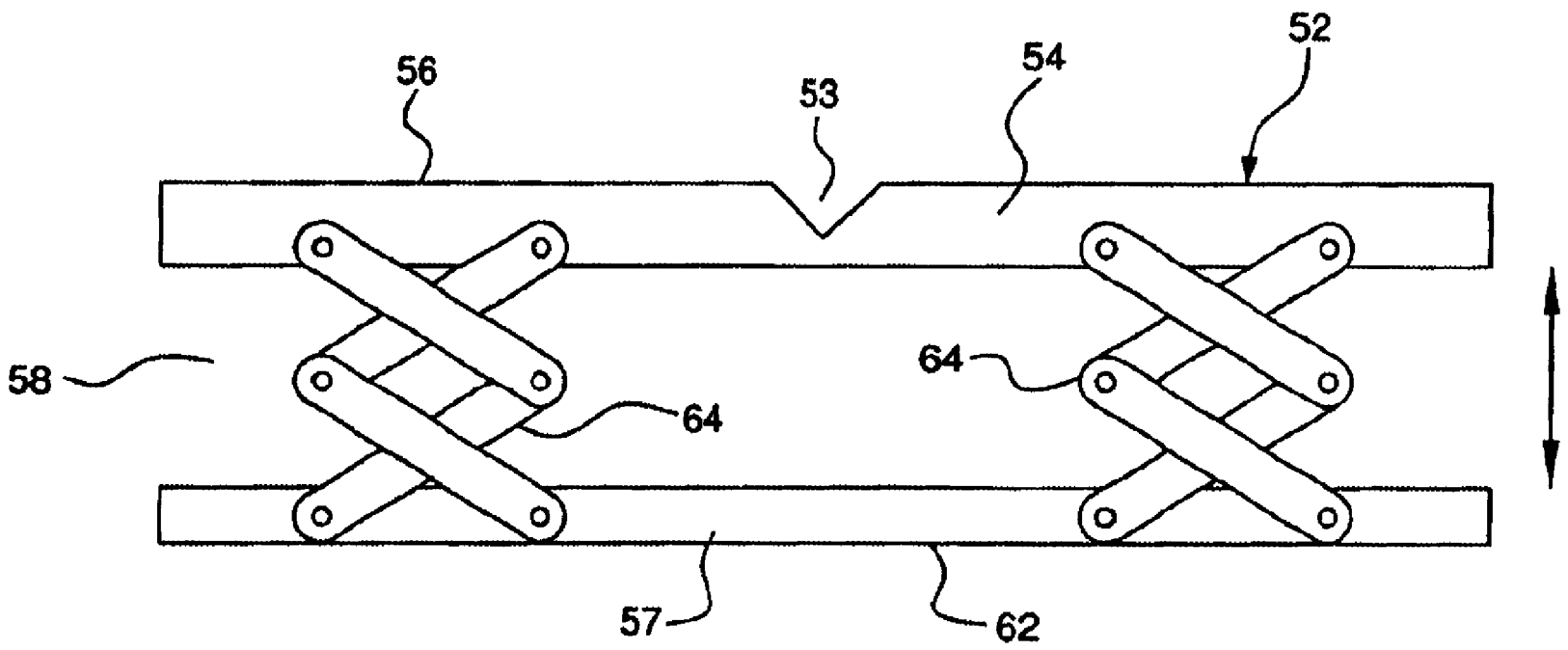
FIG. 13 is top plan view of an alternative embodiment of a template according to the invention.

FIG. 13 shows an alternative embodiment of a template 52 for laying out an envelope blank from a sheet of material. The template 52 is preferably made of a lightweight material, such as plastic. The template 52 is similar to template 10 discussed above in that it includes a substantially flat straightedge portion 54 associated with an alignment portion 58.

The straightedge portion 54 includes a peripheral layout edge 56 that is used as a guide to form a line representing a layout line for the envelope blank. Preferably, the straightedge portion 54 includes a cutout or opening, such as a notch 53, which is used to place the template 52 on the sheet of material and form relieved areas of the envelope blank. The notch 53 is preferably V-shaped, and is formed in approximately the center of the edge 56 to partition the edge 56 into two substantially coequal lengths. As explained with respect to template 10, the notch 53 does not have to be V-shaped and can be replaced by other types of guides or indicia such as a circular opening or other symbol to use as a guide to locate the proper position of the template 52 on the sheet of material.

The alignment portion 58 of template 52 has an alignment field that is defined by a straightedge portion 57. The straightedge portion 57 is used to adjust the position and orientation of the edge 56 on the sheet of material and includes an alignment element, such as an edge 62, is aligned parallel to the edge 56. Straightedge portion 57 is movably joined to straightedge portion 54 by an extension mechanism 64 (two such mechanism are shown) so that the position of edge 62 can be adjusted. The extension mechanism 64 in the preferred embodiment shown in FIG. 13 is an extension linkage that extends and contracts so that straightedge portions 54 and 57 to move either toward or away from each other to adjust the position of the edge 62. By extending or contracting the extension mechanism 64, the position of the edge 62 can be used to adjust the orientation of edge 56 on the sheet of material by lining up the edge 62 with two diagonally opposed marks. In that way, edge 62 functions in much the same way as lines 24 and 26 of the scale 22 of template 10 are used to adjust the orientation of edge 16.

For example, returning to FIG. 5, template 52 can replace template 10 to lay out the envelope blank. The template 52 would be placed on the surface of the paper 30 relative to one of the marks 36*a*–36*d,* which are each used as a separate reference. To place the template 52 in proper position, the straightedge portion 54 is moved so that at least one of the marks (such as 36*a*) is positioned at the apex of the notch 53. After the template 52 is manipulated so that mark 36*a* is located in the notch 53, the alignment portion 58 is used to adjust the orientation of edge 56 to locate the proper position of the first layout line for the envelope blank. The edge 56 is aligned by moving the template 52 and either expanding or contracting the extension mechanism 64 as necessary, until the diagonal line intermediate marks 36*b* and 36*d* are lined up as parallel as possible to edge 62. Once the edge 62 and the diagonal defined by the marks 36*b* and 36*d* are so aligned, a line representing the first layout line for the envelope blank is drawn by the user substantially along the entire length of edge 56, including the notch.

After the first layout line is drawn, the process is repeated using each of the remaining marks 36*b*–36*d* as a separate reference for notch 53 to locate the position of the remaining layout lines of the envelope blank to be formed. For example, template 52 can be moved so that mark 36*b* is located within the notch 53. Once mark 36*b* is in position, the edge 56 is aligned by manipulating the template 52 and either expanding or contracting the extension mechanism 64 as necessary until edge 62 is aligned as parallel as possible with the diagonal defined by marks 36*a* and 36*c,* as shown in FIG. 6. After the edge 56 is aligned, a line representing the next layout line is drawn substantially along edge 56. This process is repeated for each of the remaining marks, 36*c* and 36*d,* to produce four layout lines which intersect each other to form the rhomboid pattern, which is the envelope blank 38. Once the envelope blank is laid out, it can be removed from the paper by trimming off the excess material outside the layout lines.

Figure 14:
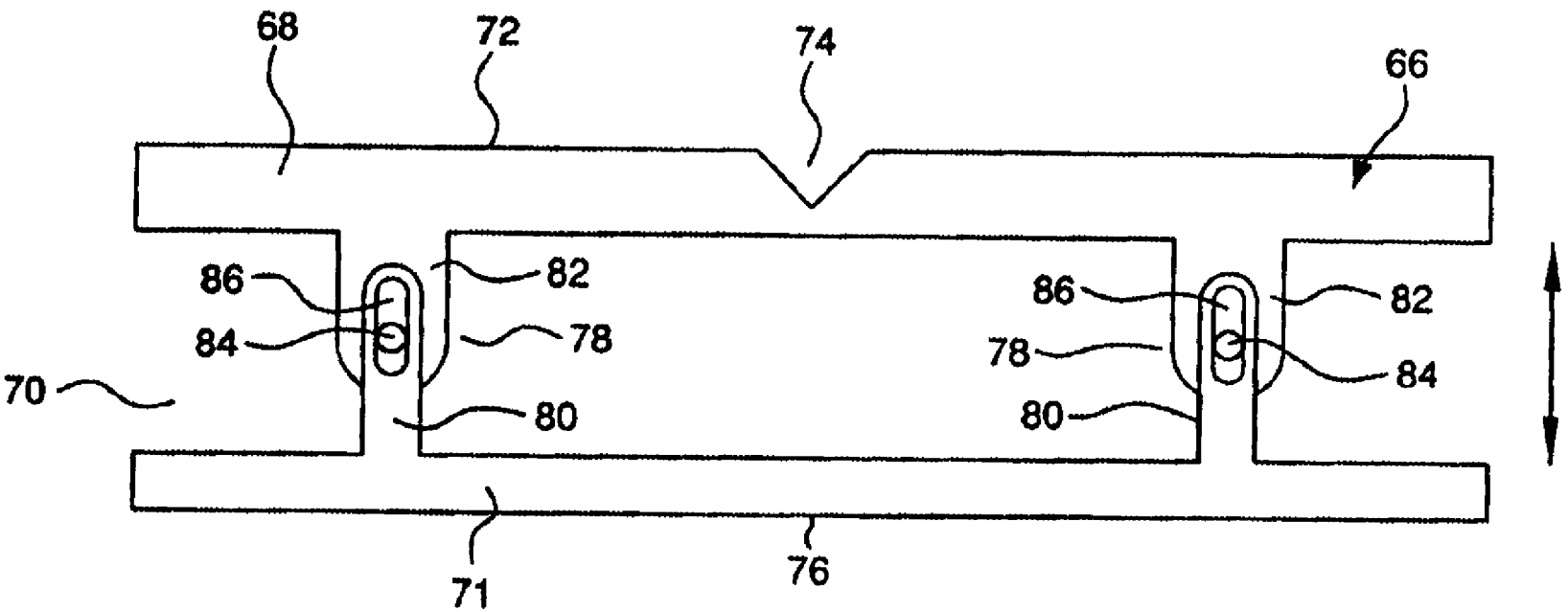
FIG. 14 is a top plan view of another alternative embodiment of a template according to the invention.

FIG. 14 shows another alternative embodiment of a template 66 for laying out an envelope blank. Similar to template 52, template 66 includes a straightedge portion 68 associated with an alignment portion 70. The straightedge portion 68 has a peripheral layout edge 72 that is used as a guide for form a line representing a layout line of an envelope blank. Preferably, the edge 72 includes a cutout or opening, such as a notch 74, which is used to place the template 66 on the sheet of material at the proper location and form relieved areas of the envelope blank. Notch 74 is preferably V-shaped, and is located approximately the center of the straightedge portion 68 to partition the edge 72 into two substantially coequal lengths. Although the preferred shape for the notch 74 is V-shaped, shapes other than V-shaped can be used in keeping with the scope of the invention. In addition, although not preferred, the notch 74 can be omitted and replaced by some other form of indicium, such a circular opening or a symbol on template 66 to place the template 66 at the proper location on the sheet of material.

The alignment portion 70 includes an alignment field defined by a straightedge portion 71 movably joined to straightedge portion 68. Straightedge portion 71 includes an alignment element, such as edge 76, aligned parallel to edge 72 of straightedge portion 68. Straightedge portions 68 and 71 are joined by an extension mechanism 78. However, in contrast to the embodiment of the template 52 shown in FIG. 13, the extension mechanism 78 is an interlocking slide mechanism.

The slide mechanism 78 comprises an arm 80 of portion 71 that is slidably coupled to an arm 82 of portion 68 by a pin 84. Preferably, pin 84 is joined to arm 82 and is adapted to slide within a groove formed within arm 80, as arms 80 and 82 slide relative to each other. The sliding motion of arms 80 and 82 allows the straightedge portions 68 and 71 to slide either toward or away from each other. By moving the straightedge portions 68 or 71, the position of edge 76 can be used to adjust the orientation of edge 56 on the sheet of material by lining-up the edge 76 with two diagonally opposed marks. In that way, edge 76 functions in much the same way as lines 24 and 26 of the scale 22 of template 10 are used to adjust the orientation of edge 16. It should be appreciated that the length of each arm can be either increased or decreased to control the amount of extension or contraction intermediate straightedge portions 68 and 71.

Template 66 is used in a manner similar to template 52 to form a layout line on the sheet of material for the envelope blank. For example, the template 66 can be placed on the surface of a sheet of material, such as paper 30 shown in FIG. 5, by locating at least one of the marks in the apex of the notch 74 of straight edge portion 68. After the template 66 is manipulated so that the mark is located within the notch 74, the alignment portion 70 is used to align the edge 72 on the sheet of material to locate the position of the first layout line for the envelope blank. The edge 74 is aligned by moving the template 66 and sliding the straightedge portion 71 either toward or away from straightedge portion 68 as necessary until the diagonal defined by two diagonally opposed marks are lined up as parallel as possible to the location of the edge 76. Once the edge 76 and the diagonal of the marks are so aligned, a line representing the first layout line for the envelope blank is drawn by the user along substantially the entire length of the edge 72, including the notch 74. After the first layout line is drawn, the process can be repeated, using each of the remaining marks as the reference mark for notch 74 to form the remaining layout lines. Once the envelope blank is laid out, it can be cut from the paper by trimming off the excess material outside the layout lines.

The embodiments of the template for laying out the envelope blanks have been described as comprising a straightedge portion and an alignment portion. However, other embodiments are contemplated. For example, it is contemplated that the layout edge (including the notch) of the straightedge portion may be replaced by one or more similarly shaped grooves or slots formed within the straightedge portion to be used as a guide to form the layout lines. It is also contemplated that the edge associated with the straightedge portion of the alignment portion may also be replaced by a groove, a slot, or other means to adjustably align the edge of the straightedge portion by moving the template and/or adjusting the position of the straightedge portion until two diagonally opposed marks are located as closely as possible within the groove. Other means for aligning the layout edge to locate the position of the layout line for the envelope blank may be used.

Persons skilled in the art will recognize that there may be different devices, mechanisms, and methods of operation which are within the spirit and scope of the invention as defined in the claims. Also, it should be understood that the drawings, while useful in illustrating the invention, are not intended to be necessarily to scale. The dimensions and relative sizes and locations of the various parts shown can be varied, depending upon the particular optical storage media being used, without departing from the scope of the invention. To the extent that the drawings imply dimensions and relative size positions, the drawings should be regarding as illustrative only and not limiting the invention to particular dimensions, sizes, position, and location of parts.

Finally, the present invention may be embodied in other specific forms without departing from the spirit or essential attributes thereof and, accordingly, reference should be made to the appended claims, rather than to the foregoing specification, as indicating the scope of the invention.

I claim:

1. A method of laying out an envelope blank from a sheet of material using a template comprising a straightedge portion having a layout edge with a locating portion to form a line representing a layout line of the envelope blank, and an alignment portion integrally associated with the straightedge portion and having an alignment field with an alignment element to adjustably align the layout edge on the sheet of material, the method comprising the steps of:

(a) placing an item to be enclosed in an envelope on the sheet of material, (b) placing marks on the sheet to approximately locate the corners of the item, the marks being used as a reference, (c) removing the item from the sheet, (d) placing the template on the sheet relative to at least one mark using the locating portion, (e) using the alignment field to align the layout edge on the sheet to locate the position of a first layout line of the envelope blank, by moving the template as necessary until a diagonal line defined by two diagonally opposed marks is aligned as parallel to the aligning element, (f) drawing a line substantially along the entire length of the layout edge to represent the first layout line, (g) placing the template on the sheet of material relative to another mark, (h) using the alignment field to align the layout edge on the sheet to locate the position of another layout line of the envelope blank, by moving the template as necessary until a diagonal line defined by two diagonally opposed marks is aligned as parallel to the aligning element, (i) drawing a line substantially along the entire length of the layout edge to represent another layout line of the envelope blank, (j) repeating steps (g) through (i) as necessary with respect to each of the remaining marks to draw lines representing the remaining layout lines of the envelope blank, and (k) cutting the envelope blank from the sheet.

2. The method as claimed in claim 1, wherein the step of placing the template relative to the at least one mark further comprises the step of positioning the at least one mark at the apex of an opening of the layout edge.

3. The method as claimed in claim 1, wherein the sheet of material is of paper stock, card stock or transparency stock.

4. The method as claimed in claim 1, wherein the template is of a lightweight material.

5. The method as claimed in claim 1, wherein the template is plastic.

6. The method as claimed in claim 1, wherein the opening of the layout edge is a notch, groove or slot.

7. A method of laying out an envelope blank from a sheet of material using a template comprising a straightedge portion having a layout edge with a locating portion to form a line representing a layout line of the envelope blank, and an alignment portion having an alignment field with an alignment element to adjustably align the layout edge on the sheet of material, said alignment field movably attached to the straightedge portion by an extension mechanism for extending the alignment field, the method comprising the steps of:

(a) placing an item to be enclosed in an envelope on the sheet of material, (b) placing marks on the sheet to approximately locate the corners of the item, the marks being used as a reference, (c) removing the item from the sheet, (d) placing the template on the sheet relative to at least one mark using the locating portion, (e) using the alignment field to align the layout edge on the sheet to locate the position of a first layout line of the envelope blank by aligning the layout edge by moving the template as necessary until a diagonal line defined by two diagonally opposed marks is aligned as parallel as possible to the alignment element, (f) drawing a line substantially along the entire length of the layout edge to represent the first layout, (g) placing the template on the sheet of material relative to another mark, (h) using the alignment field to align the layout edge on the sheet to locate the position of another layout line of the envelope blank by moving the template as necessary until a diagonal line defined by two diagonally opposed marks is aligned as parallel as possible to the alignment element, (i) drawing a line substantially along the entire length of the layout edge to represent another layout line of the envelope blank, (j) repeating steps (g) through (i) as necessary with respect to each of the remaining marks to draw lines representing the remaining layout lines of the envelope blank, and (k) cutting the envelope blank from the sheet.

8. The method as claimed in claim 7, wherein the step of placing the template relative to the at least one mark further comprises the step of positioning the at least one mark at the apex of an opening of the layout edge.

9. The method as claimed in claim 7, wherein the extension mechanism is an interlocking slide mechanism.

10. The method as claimed in claim 7, wherein the sheet of material is of paper stock, card stock or transparency stock.

11. The method as claimed in claim 7, wherein the template is of a lightweight material.

12. The method as claimed in claim 7, wherein the template is plastic.

13. The method as claimed in claim 7, wherein the opening of the layout edge is a notch, groove or slot.

* * * * *